US012345118B2

(12) United States Patent
Miike

(10) Patent No.: US 12,345,118 B2
(45) Date of Patent: Jul. 1, 2025

(54) DOWNHOLE PLUG DEVICE, TUBE AFFIXING METHOD, AND TUBE INSPECTION METHOD

(71) Applicant: KUREHA CORPORATION, Tokyo (JP)

(72) Inventor: Ramu Miike, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 38 days.

(21) Appl. No.: 18/573,253

(22) PCT Filed: Feb. 16, 2022

(86) PCT No.: PCT/JP2022/006066
§ 371 (c)(1),
(2) Date: Dec. 21, 2023

(87) PCT Pub. No.: WO2023/276248
PCT Pub. Date: Jan. 5, 2023

(65) Prior Publication Data

US 2024/0309725 A1 Sep. 19, 2024

(30) Foreign Application Priority Data

Jun. 30, 2021 (JP) ..... 2021-109530

(51) Int. Cl.
*E21B 33/12* (2006.01)
*E21B 47/117* (2012.01)

(52) U.S. Cl.
CPC ..... *E21B 33/1208* (2013.01); *E21B 33/12* (2013.01); *E21B 47/117* (2020.05); *E21B 2200/08* (2020.05)

(58) Field of Classification Search
CPC ..... E21B 33/10; E21B 33/12; E21B 33/1208; E21B 17/14
See application file for complete search history.

(56) References Cited

U.S. PATENT DOCUMENTS 3,082,824 A * 3/1963 Taylor ..... E21B 33/1293 166/134
3,158,202 A * 11/1964 Lewis ..... E21B 33/1265 166/134

(Continued)

FOREIGN PATENT DOCUMENTS

CN 208830947 U 5/2019

OTHER PUBLICATIONS

International Preliminary Report on Patentability and English translation of the Written Opinion of the International Searching Authority for International Application No. PCT/JP2022/006066, dated Jan. 11, 2024.

(Continued)

*Primary Examiner* — Robert E Fuller
(74) *Attorney, Agent, or Firm* — Birch, Stewart, Kolasch & Birch, LLP

(57) ABSTRACT

A downhole plug device, a fixing method of a tubular body, and an inspection method of a tubular body. In a downhole plug device, a plug that seals one end of a housing having a cylindrical shape is fixed to the housing by a bolt that penetrates through the plug. The downhole plug device is connected to a tip of a tubular body inserted into a casing in a well and is used for a method of inspecting presence or absence of leakage of fluid from the tubular body in the well.

9 Claims, 9 Drawing Sheets

(56) References Cited

U.S. PATENT DOCUMENTS

| | | | | |
|---|---|---|---|---|
| 10,151,169 | B2 | 12/2018 | Dedman et al. | |
| 11,021,926 | B2 | 6/2021 | Smith et al. | |
| 11,280,143 | B2 | 3/2022 | Robicheaux et al. | |
| 2009/0065196 | A1* | 3/2009 | Holland | E21B 43/105 166/380 |
| 2016/0333660 | A1 | 11/2016 | Dedman et al. | |
| 2020/0032610 | A1 | 1/2020 | Smith et al. | |
| 2020/0362653 | A1 | 11/2020 | Robicheaux et al. | |

OTHER PUBLICATIONS

Canadian Office Action for Canadian Application No. 3,222,896, dated Mar. 6, 2025.

* cited by examiner

[FIG. 1]
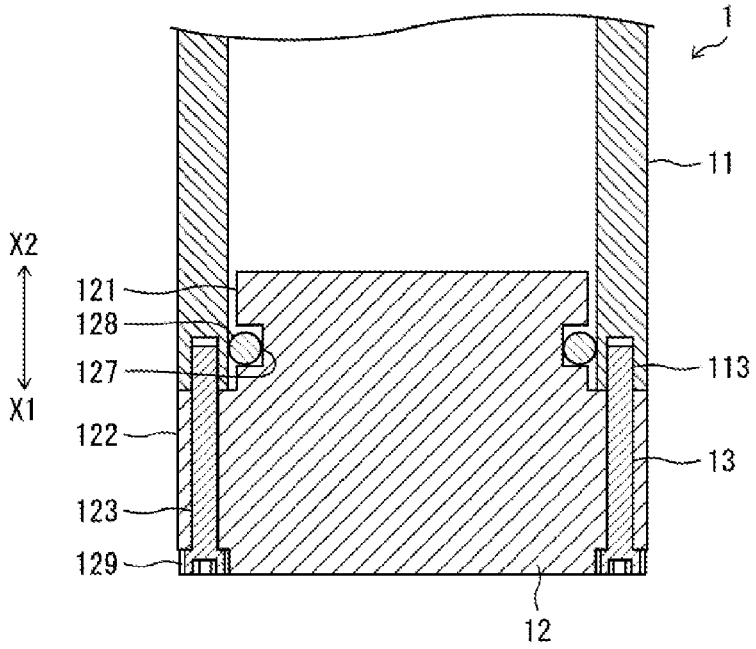
[FIG. 2]
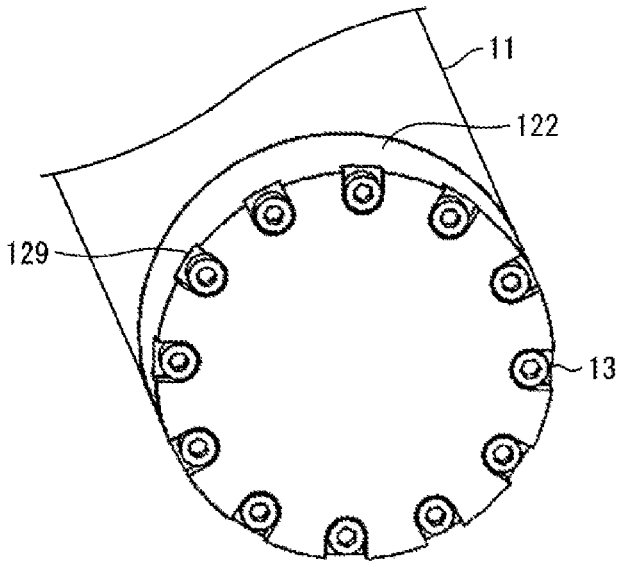

[FIG. 3]
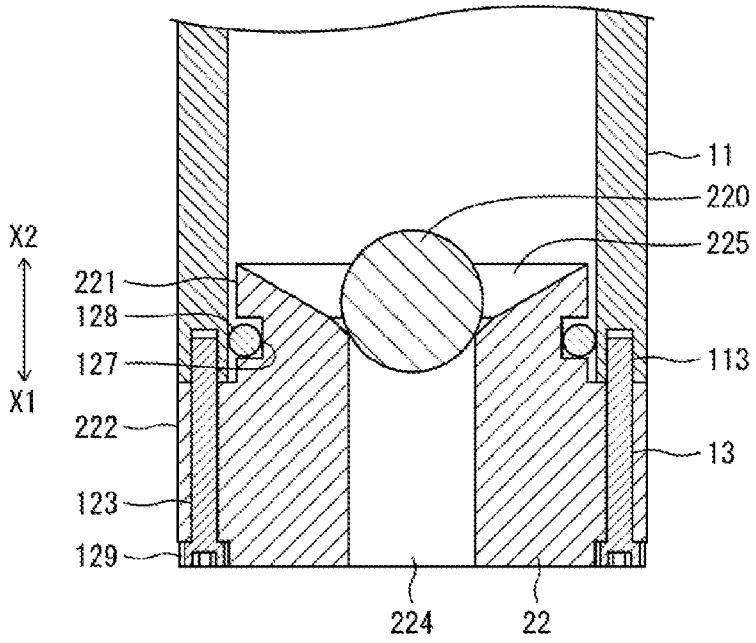
[FIG. 4]
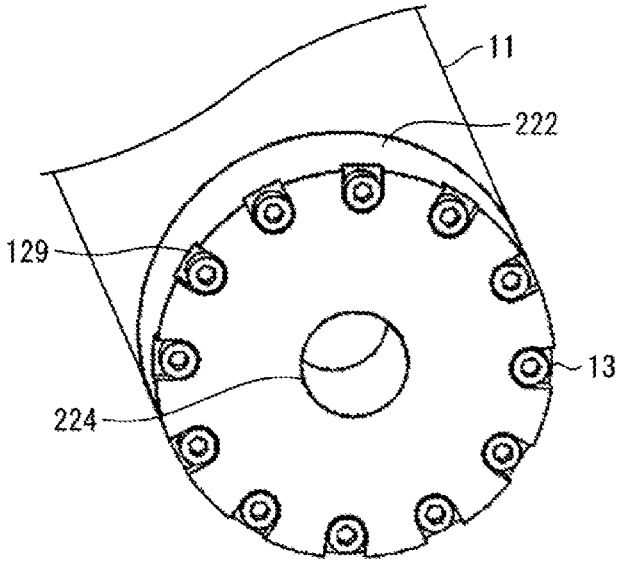

[FIG. 5]
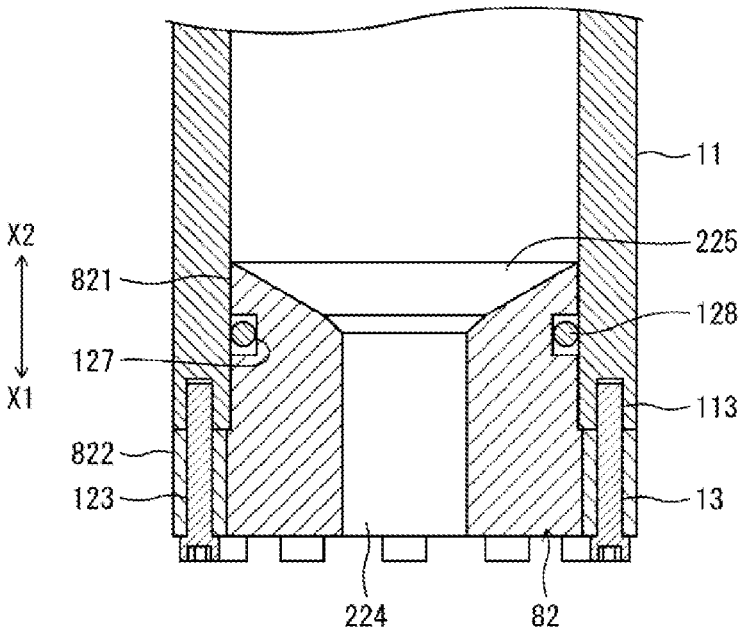
[FIG. 6]
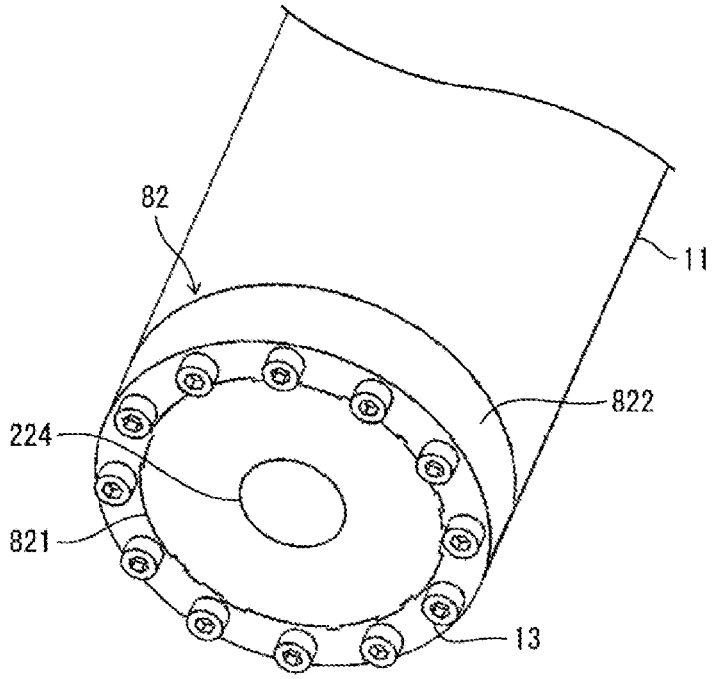

[FIG. 7]
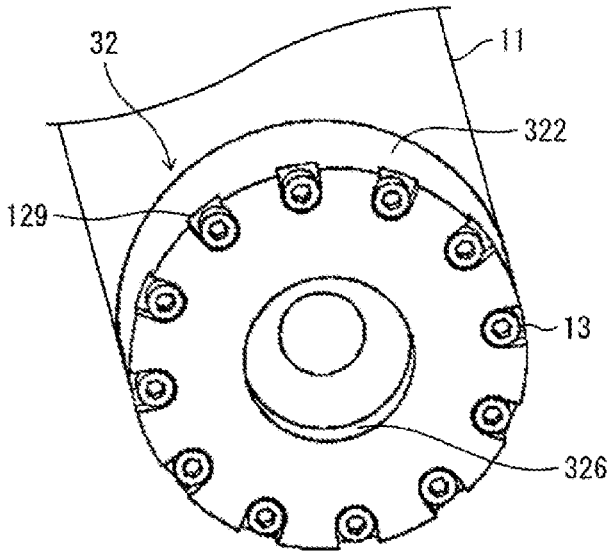
[FIG. 8]
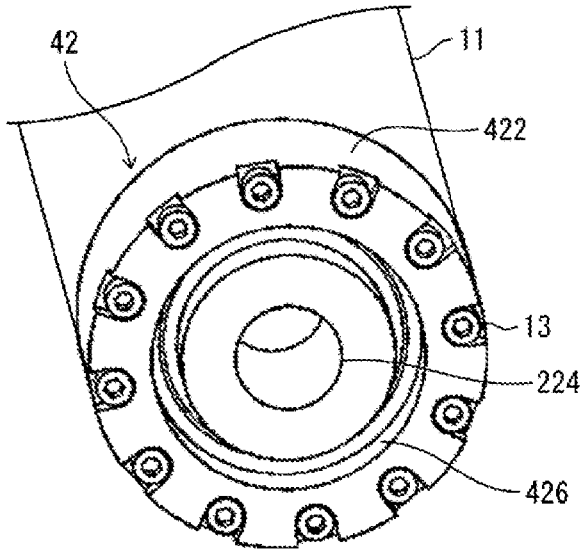

[FIG. 9]
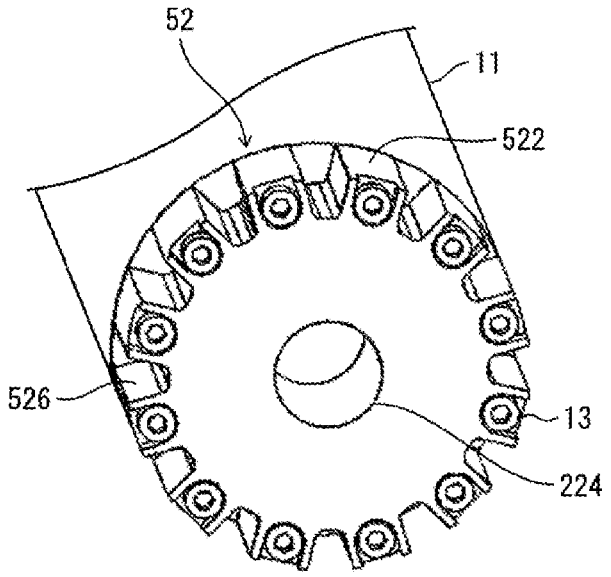
[FIG. 10]
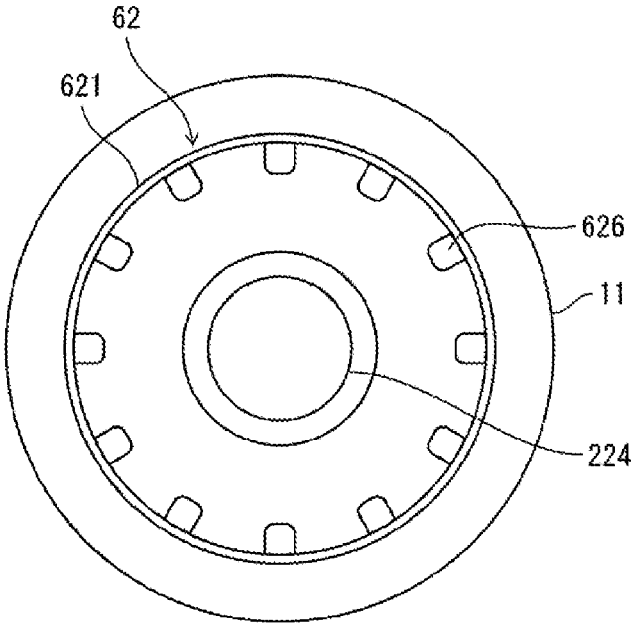

[FIG. 11]
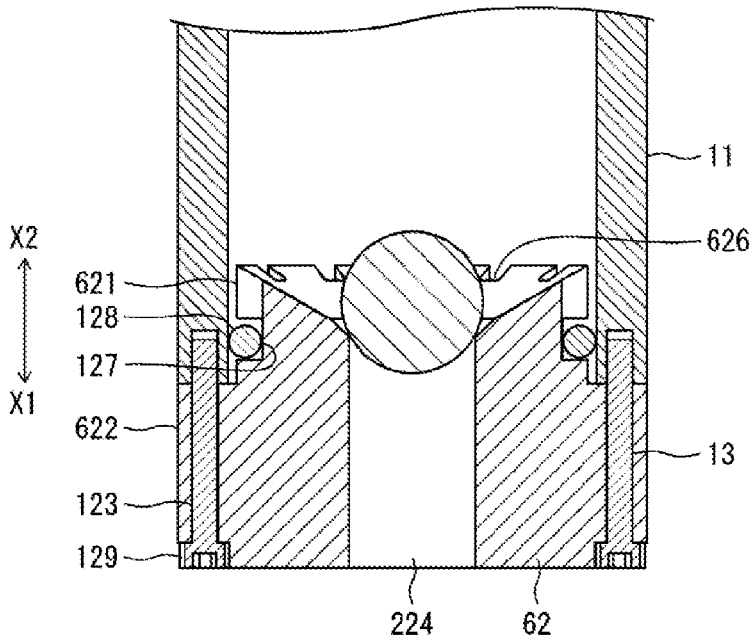
[FIG. 12]
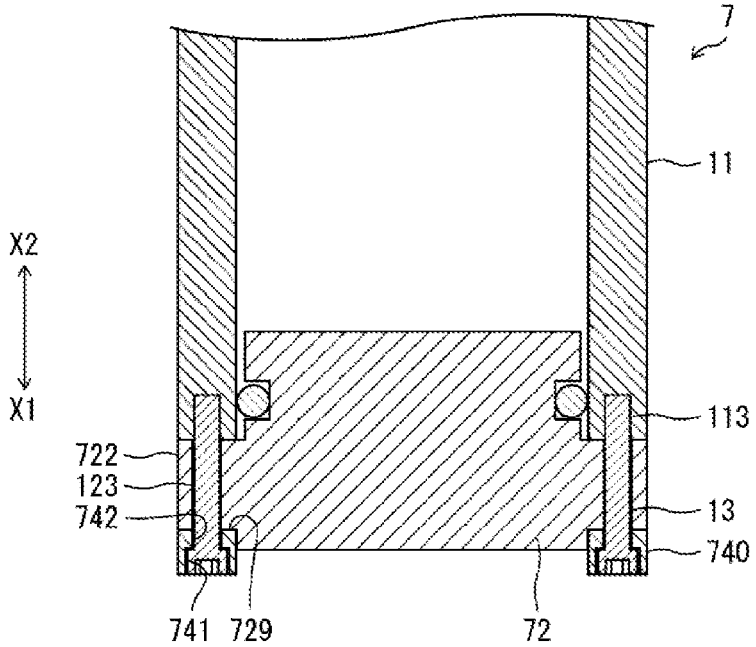

[FIG. 13]
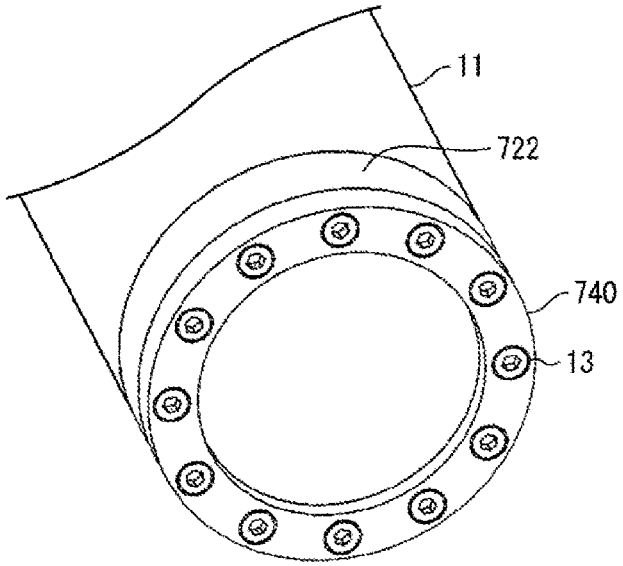
[FIG. 14]
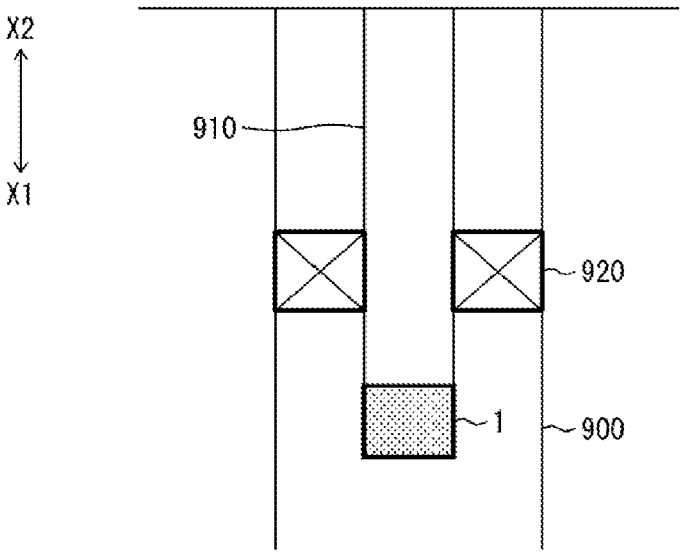

[FIG. 15]
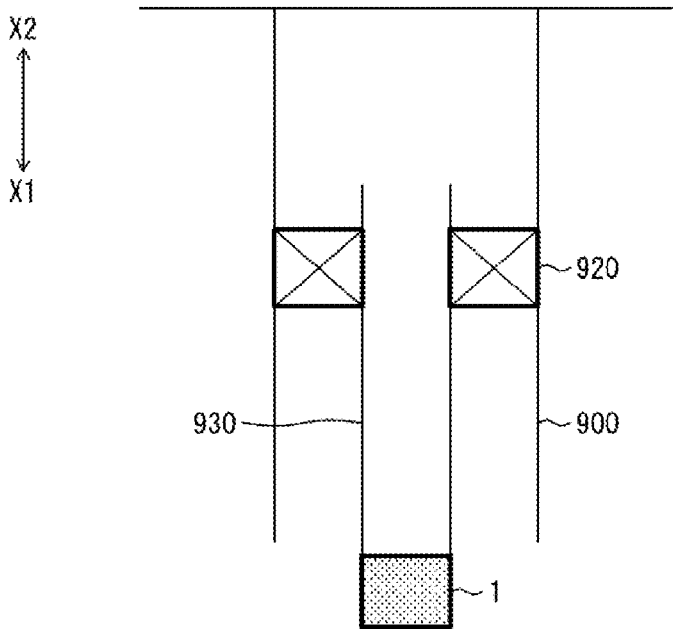
[FIG. 16]
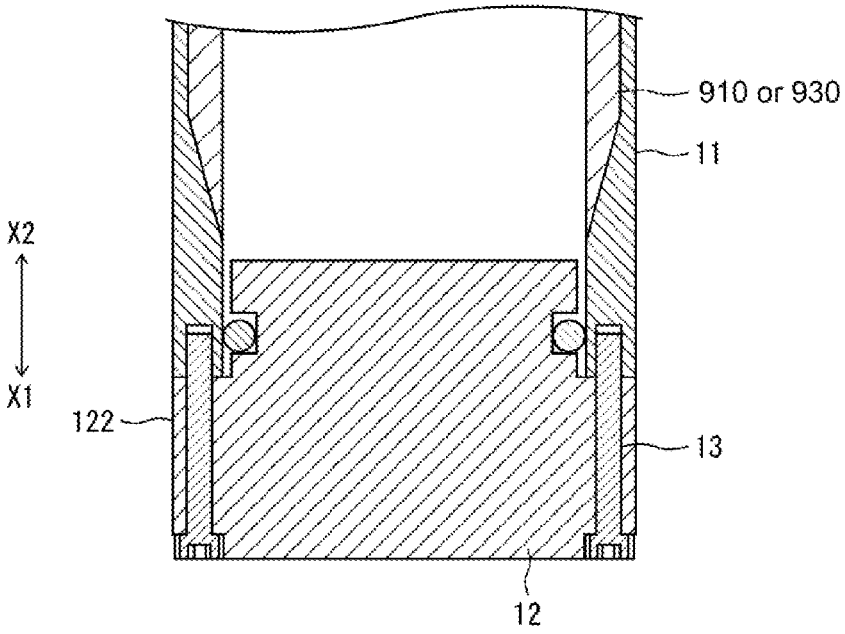

[FIG. 17]
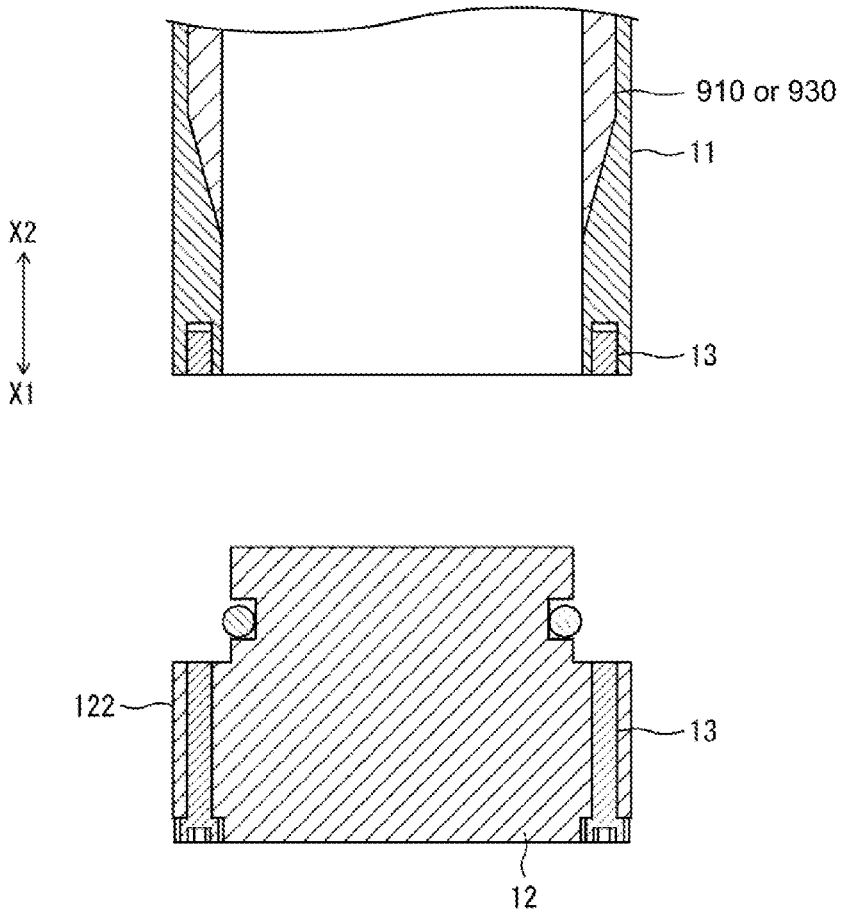

DOWNHOLE PLUG DEVICE, TUBE AFFIXING METHOD, AND TUBE INSPECTION METHOD

TECHNICAL FIELD

The present invention relates to a downhole plug device, a fixing method of a tubular body, and an inspection method of a tubular body.

BACKGROUND ART

Various tubular bodies are used in wells extending from the ground to a subterranean formation. For example, to recover fluid from a subterranean formation, a tubing that is a tubular body is inserted into a well, forming a flow path connecting the ground and the subterranean formation. The tubular body is sometimes formed by connecting a plurality of tubes. To inspect presence or absence of leakage of fluid from the tubular body, a pressure test of the tubular body is typically performed prior to the use of the tubular body. The pressure test is performed by connecting a pump-out plug to a tip of the tubular body and injecting fluid from the ground into the underground to increase the internal pressure of the tubular body. The pump-out plug includes a housing having a cylindrical shape and a plug that hermetically seals the housing. After the pressure test, the plug is pushed by the further increased internal pressure of the tubular body and is removed from the housing.

In known configurations in which a housing is temporarily sealed by a plug in this manner, a plug is fixed in a housing by a shear pin extending in a direction intersecting an axial direction of the housing (see, for example, Patent Documents 1 and 3). In another known configuration, a plug is fixed in a housing by fitting a protrusion on the outer circumference of the plug into a recessed part on the inner circumference of the housing (see, for example, Patent Document 2).

CITATION LIST

Patent Literature

Patent Document 1: US 2016/0,333,660 A
Patent Document 2: US 2020/0,032,610 A
Patent Document 3: CN 208830947 U

SUMMARY OF INVENTION

Technical Problem

In the known art, surface irregularities in an axial direction are formed on the inner circumferential surface of the housing after removal of the plug, posing a potential obstacle to the subsequent utilization of the tubular body. For example, the techniques described in Patent Documents 1 and 3 may cause a broken shear pin to protrude from the inner circumferential surface of the housing after removal of the plug. The technique described in Patent Document 2 leaves a recessed part of the housing into which a protrusion on the outer circumference of the plug has been fitted.

Surface irregularities of the inner circumferential surface of the housing cause the inner diameter of the housing to change in an axial direction of the housing. In particular, part having a suddenly reduced inner diameter, that is, the protrusion on the inner circumference of the housing may cause some other downhole tool to be inserted from the ground after removal of the plug to be caught on the protrusion, hindering the entry or recovery of the downhole tool.

An object of the present invention is to provide a downhole plug device that is less likely to hinder other operations after being removed, a fixing method of a tubular body, and an inspection method of a tubular body.

Solution to Problem

To solve the problem above, a downhole plug device according to an aspect of the present invention is used for temporarily sealing a tubular body to be inserted into a well by fitting into the tubular body at a tip of the tubular body. The downhole plug device includes a housing having a cylindrical shape, a plug that is inserted into the housing from one end of the housing and abuts one end surface of the housing to seal the housing, and a fixing part that is inserted through the plug along an axial direction of the housing and fixes the plug to the one end surface of the housing.

To solve the problem above, a fixing method of a tubular body according to an aspect of the present invention includes fixing a tubular body inserted into a well including a casing to the casing by increasing an internal pressure of the tubular body with a tip of the tubular body sealed by a downhole plug device disposed at the tip of the tubular body to push the downhole plug device and moving the downhole plug device toward a well bottom side with respect to a packer provided in the tubular body. The downhole plug device includes a housing having a cylindrical shape, a plug that is inserted into the housing from one end of the housing and abuts one end surface of the housing to seal the housing, and a fixing part that is inserted through the plug along an axial direction of the housing and fixes the plug to the one end surface of the housing.

To solve the problem above, an inspection method of a tubular body according to an aspect of the present invention of inspecting presence or absence of leakage of fluid from a tubular body in a well includes measuring an internal pressure of a tubular body inserted into a casing in a well by increasing the internal pressure with a tip of the tubular body sealed by a downhole plug device disposed at the tip of the tubular body. The downhole plug device to be used includes a housing having a cylindrical shape, a plug that is inserted into the housing from one end of the housing and abuts one end surface of the housing to seal the housing, and a fixing part that is inserted through the plug along an axial direction of the housing and fixes the plug to the one end surface of the housing.

Advantageous Effects of Invention

One aspect of the present invention can provide a downhole plug device that is less likely to hinder other operations after being removed, a fixing method of a tubular body, and an inspection method of a tubular body.

BRIEF DESCRIPTION OF THE DRAWINGS

FIG. 1 is a cross-sectional view schematically illustrating a configuration of a downhole plug device according to a first embodiment of the present invention.

FIG. 2 is a perspective view schematically illustrating the downhole plug device illustrated in FIG. 1 as viewed from a plug side.

FIG. 3 is a cross-sectional view schematically illustrating a configuration of a plug and its peripheral part in a downhole plug device according to a second embodiment of the present invention.

FIG. 4 is a perspective view schematically illustrating the downhole plug device illustrated in FIG. 3 as viewed from a plug side.

FIG. 5 is a cross-sectional view schematically illustrating a configuration of a plug and its peripheral part in a downhole plug device according to a third embodiment of the present invention.

FIG. 6 is a perspective view schematically illustrating the downhole plug device illustrated in FIG. 5 as viewed from a plug side.

FIG. 7 is a perspective view schematically illustrating a downhole plug device according to a fourth embodiment of the present invention as viewed from a plug side.

FIG. 8 is a perspective view schematically illustrating a downhole plug device according to a fifth embodiment of the present invention as viewed from a plug side.

FIG. 9 is a perspective view schematically illustrating a downhole plug device according to a sixth embodiment of the present invention as viewed from a plug side.

FIG. 10 is a plan view schematically illustrating a downhole plug device according to a seventh embodiment of the present invention as viewed from the opposite side of a plug.

FIG. 11 is a cross-sectional view schematically illustrating a configuration of the plug and its peripheral part in the downhole plug device illustrated in FIG. 10.

FIG. 12 is a cross-sectional view schematically illustrating a configuration of a downhole plug device according to an eighth embodiment of the present invention.

FIG. 13 is a perspective view schematically illustrating the downhole plug device illustrated in FIG. 12 as viewed from a plug side.

FIG. 14 is a diagram schematically illustrating an example of an installation state of a downhole plug device in a method of using a tubular body according to an embodiment of the present invention.

FIG. 15 is a diagram schematically illustrating another example of an installation state of a downhole plug device in a method of using a tubular body according to an embodiment of the present invention.

FIG. 16 is a diagram schematically illustrating a state in which a downhole plug device is connected to a tip of a tubular body in a method of using a tubular body according to an embodiment of the present invention.

FIG. 17 is a diagram schematically illustrating a state in which a housing causes a tubular body to communicate with the outside after detachment of a plug in a method of using a tubular body according to an embodiment of the present invention.

DESCRIPTION OF EMBODIMENTS

An embodiment of the present invention will be described below.

Downhole plug device

(1) Main Configuration

FIG. 1 is a cross-sectional view schematically illustrating a configuration of a downhole plug device according to a first embodiment of the present invention. FIG. 2 is a perspective view schematically illustrating the downhole plug device illustrated in FIG. 1 as viewed from a plug side. As illustrated in FIG. 1, a downhole plug device 1 according to the present embodiment includes a housing 11, a plug 12, and a bolt 13. The lower part of the drawing, that is, a direction indicated by an arrow X1 is referred to as a first direction, and a direction indicated by an arrow X2 is referred to as a second direction. For example, the end in the first direction is referred to as a first end, and the end in the second direction is referred to as a second end.

The housing 11 is a cylindrical member. The housing 11 is connected to a tubular body (not illustrated) at the second end of the housing 11, as will be described below. The housing 11 and the tubular body are fastened to each other by, for example, a threaded part engraved on an inner circumference of the housing and a threaded part engraved on an outer circumference of the tubular body. However, the form of connecting the housing 11 and the tubular body is not limited, and known means can be used as the connecting means. An inner circumferential surface of the housing 11 connected to the tubular body has no irregular shape in an axial direction with the housing 11 connected to the tubular body, and the housing 11 has a constant inner diameter from the first end to the second end.

The plug 12 is inserted into the housing 11 from the first end of the housing 11 and abuts an end surface to seal the housing 11. The plug 12 is fixed to the first end of the housing 11 by a fixing part inserted through the plug 12 along an axial direction of the housing 11.

The bolt 13, which is an embodiment of the fixing part, is inserted through the plug 12 along the axial direction of the housing 11 and fixes the plug 12 to one end surface of the housing 11. Other embodiments of the fixing part will be described later.

(2) Structure Related to Fixing

In the first embodiment of the present invention, the plug 12 includes a main body part 121 and a head part 122. The main body part 121 is inserted into the housing 11 from the first end of the housing 11. The head part 122 has an outer diameter larger than the main body part 121 and abuts a first end surface of the housing 11 with the main body part 121 inserted into the housing 11. The plug 12 is an integrated object of the main body part 121 and the head part 122, and the main body part 121 and the head part 122 both have a columnar shape. An outer diameter of the main body part 121 is substantially the same as an inner diameter of the housing 11. An outer diameter of the head part 122 is the same as or slightly smaller than an outer diameter of the housing 11.

The head part 122 includes a plurality of bolt holes 123 that extend along the axial direction of the housing 11 and open to the first end surface of the housing 11. The housing 11 includes a plurality of bolt recesses 113 opening at the first end surface of the housing 11. The bolt 13 is inserted through the bolt hole 123 and screwed into the bolt recess 113 to fix the plug 12 to the housing 11.

Note that the bolt 13 is fixed to the housing 11 through the plug 12 from a first end side of the downhole plug device 1 and that such a member can be used instead of the bolt 13 in the present embodiment. Examples of such a member other than the bolt 13 include an anchor bolt, a bayonet lock, and a bayonet joint.

(3) Other Embodiments of Plug

The plug 12 only needs to be able to seal the housing 11 and embodiments are not limited to the configuration above. FIG. 3 is a cross-sectional view schematically illustrating a configuration of a plug and its peripheral part in a downhole plug device according to a second embodiment of the present invention. FIG. 4 is a perspective view schematically illustrating the downhole plug device illustrated in FIG. 3 as viewed from a first end side.

As illustrated in FIG. 3, a plug 22 further includes a through hole 224 and a valve seat 225 and is configured in the same manner as the plug 12 except further including a ball 220 serving as a valve body that can be seated on the valve seat 225. The through hole 224 penetrates through the plug 22, that is, both the main body part 221 and the head part 222 along an axial direction of the plug 22. The valve seat 225 is formed around the opening of the through hole 224 at a second end side of the plug 22. The valve seat 225 is a tapered surface whose inner diameter gradually increases from the opening of the through hole 224 to the outer circumference of the plug 22 at the second end of the plug 22. The ball 220 has a diameter larger than an opening diameter of the through hole 224 and seals the through hole 224 when closely attached to the valve seat 225.

As yet another embodiment, the part forming the plug 12 and the part forming the valve seat 225 of the plug 22 can be made of two or more members. FIG. 5 is a cross-sectional view schematically illustrating a configuration of a plug and its peripheral part in a downhole plug device according to a third embodiment of the present invention. FIG. 6 is a perspective view schematically illustrating the downhole plug device illustrated in FIG. 5 as viewed from a first end side.

As illustrated in FIGS. 5 and 6, a plug 82 is composed of a core member 821 and a peripheral ring member 822, and the core member 821 and the peripheral ring member 822 are engaged with each other by an engaging means. Examples of the engaging means include bonding with an adhesive as well as fastening with screw threads each engraved on an outer circumferential surface of the core member 821 and an inner circumferential surface of the peripheral ring member 822. An inner diameter of the peripheral ring member 822 may be larger or smaller than the inner diameter of the housing 11. In order to prevent detachment of the core member 821 toward the X1 direction, the inner diameter of the peripheral ring member 822 is preferably smaller than the inner diameter of the housing 11. The peripheral ring member 822 is preferably formed of a material having strength higher than the core member 821, such as a metal material.

(4) Embodiments in Which a Plug Includes a Groove and/or a Recess

In an embodiment of the present invention, a plug may include either or both of a groove and a recess on its surface. Specific examples will be presented below, but embodiments according to the present invention are not limited thereto. For example, the plug may be a solid member without a through hole, such as the plug 12. The embodiments of the groove or the recess may be combined to the extent that the embodiments are effective.

FIG. 7 is a perspective view schematically illustrating a downhole plug device according to a fourth embodiment of the present invention as viewed from a first end side. As illustrated in FIG. 7, a plug 32 includes a recess 326 in a central part of a head part 322. Other configurations are similar to those of the plug 12. The recess 326 is a dent having a circular planar shape and is formed in the central part of the planar shape of a first end of the head part 322.

FIG. 8 is a perspective view schematically illustrating a downhole plug device according to a fifth embodiment of the present invention as viewed from a first end side. As illustrated in FIG. 8, a plug 42 includes a groove 426 surrounding the opening of a through hole 224 in a head part 422. Other configurations are similar to those of the plug 22. The groove 426 is a recessed line having an annular planar shape and is formed surrounding the outside of the opening of the through hole 224 in the head portion 422.

FIG. 9 is a perspective view schematically illustrating a downhole plug device according to a sixth embodiment of the present invention as viewed from a first end side. As illustrated in FIG. 9, a plug 52 includes a groove 526 in an outer circumferential part of a head part 522. Other configurations are similar to those of the plug 22. The groove 526 is a recessed line that extends along an axial direction of an outer circumferential surface of the head part 522 and that is recessed from the outer circumferential surface. The groove 526 has a substantially U-shaped cross-section. The grooves 526 are formed between adjacent bolt holes in a circumferential direction of the head part 522.

FIG. 10 is a plan view schematically illustrating a downhole plug device according to a seventh embodiment of the present invention as viewed from a second end side. FIG. 11 is a cross-sectional view schematically illustrating a configuration of a plug and its peripheral part in the downhole plug device illustrated in FIG. 10. As illustrated in FIGS. 10 and 11, a plug 62 includes a main body part 621, a head part 622, and a groove 626 on an outer circumference of a second end of the main body part 621. Other configurations are similar to those of the plug 22. The groove 626 extends on an outer circumferential surface of the plug 62 along an axial direction of the plug 62 from a second end of the plug 62 to a groove 127 that will be described later.

The grooves 626 are formed at equal intervals in the circumferential direction of the main body part 621.

(5) Other Configurations

The downhole plug device according to an embodiment of the present invention may further have another configuration in addition to the above-described configurations depending on its application.

For example, as illustrated in FIG. 1, the main body part of the plug 12 includes a groove 127 formed along a circumferential direction on an outer circumferential surface and an O-ring 128 fitted into the groove 127. Such a configuration is advantageous for increasing the airtightness of the closure of the housing 11 with the plug.

In addition, as illustrated in FIGS. 1 and 2, the head part 122 of the plug 12 further includes a recessed part 129 at a position corresponding to the bolt hole 123. The recess part 129 is formed in an end surface of the head part 122. The recessed part 129 has a depth equal to a thickness of a head part of the bolt 13 such that the bolt 13 does not protrude from the first end of the plug 12 when installed.

The bolt diameter may be designed to allow the bolt 13 to break at a predetermined water pressure. The bolt 13 may use a general-purpose product made of a material such as an aluminum alloy, a chromium molybdenum steel, a stainless steel, copper, or brass, or may use, as a bolt easily breaking, a bolt made of a die-cast alloy (aluminum die-casting, zinc die-casting). Although not illustrated in the drawings, a scratched fixture to easily break may be used in an X1 direction side from the bolt recess 113.

The bolt 13 illustrated in FIGS. 1 to 11 is a hexagon socket cap screw but may be a different bolt. For example, in an embodiment of the present invention, an oval head screw or a fully threaded rod and a hexagonal nut may be used instead of the bolt 13. Also, fixing means in addition to the above-described bolts may be used.

Further, the plug may be in direct contact with a seat surface of the bolt, or another member may be interposed between the plug and the seat surface. The other member may be, for example, a washer or a fixture as illustrated in FIGS. 12 and 13.

FIG. 12 is a cross-sectional view schematically illustrating a configuration of a downhole plug device according to an eighth embodiment of the present invention. FIG. 13 is a perspective view schematically illustrating the downhole plug device illustrated in FIG. 12 as viewed from a first end side. As illustrated in FIGS. 12 and 13, the downhole plug device 7 further includes an annular fixture 740 interposed between the head part of the bolt 13 and the plug. Instead of the recessed part 129, the plug 72 includes a notch part 729 extending along an outer circumferential edge of a first end. Other configurations are similar to those of the plug 12.

The fixture 740 is a plate-like member and has an annular planar shape. The fixture 740 includes a recessed part 741 corresponding to the head part of the bolt 13 and a hole 742 opened at the bottom of the recessed part 741 and corresponding to the bolt 13. The fixture 740 is made of, for example, metal.

Disposing the ring-shaped fixture 740 made of metal having an inner diameter equal to or larger than the inner diameter of the housing and an outer diameter equal to or smaller than the outer diameter of the housing between the bolt 13 and the plug 72 in this manner allows the plug 72 to be more firmly retained in the housing 11. In addition, the fixture 740 is provided at an outer circumferential edge part of the first end of the downhole plug device 7. As such, in inserting the downhole plug device 7 into the casing as will be described later, an effect of preventing the head of the bolt 13 from directly colliding with the casing is expected. Examples of the metal as a material of the fixture 740 include non-degradable metals such as a stainless steel, aluminum, and iron, a degradable Mg alloy, and a degradable Al alloy.

(6) Material of Each Member

A material of the downhole plug device can be appropriately selected from known materials that have been used in downhole tools, such as resins or metals. In the present embodiment, at least a portion of the plug is preferably made of a degradable material from the viewpoint of reducing the risk that a separate downhole tool getting caught and hindering the entry or recovery of the separate downhole tool.

The degradable material is a material that degrades in an environment in a well and is, for example, a hydrolyzable material that degrades with water and loses weight. In particular, the degradable material is preferably a material exhibiting a predetermined rate of decrease in thickness in the environment in a well. The "rate of decrease in thickness" is a value calculated based on the time change in "reduced thickness" which is a difference between the thickness of a molded article before the start of degradation and the thickness of the molded article at a point in time after the start of degradation.

The degradable material may be inorganic or organic. Examples of inorganic degradable materials include reactive metals, such as Mg alloys and Al alloys. Examples of organic degradable materials include degradable resins, such as a polyglycolic acid-based resin, polylactic acid, or polyvinyl alcohol, or a composition containing one or more of the compounds listed. One type or a plurality of types of the degradable material may be used in the plug. In addition, when the housing is formed of a degradable material, the plug may be formed of the same material as the housing, or of a different material. The degradable material is particularly preferably a polyglycolic acid-based resin or a polyglycolic acid-based resin composition. Hereinafter, a polyglycolic acid-based resin composition will be described as an example of a degradable material suitable for the present embodiment.

Polyglycolic Acid-Based Resin Composition

The polyglycolic acid-based resin composition contains a polyglycolic acid-based resin as a main component. The polyglycolic acid-based resin may be a homopolymer of glycolic acid or a copolymer of glycolic acid. A homopolymer is preferred over a copolymer because a molded article of a homopolymer has a higher compressive strength. Meanwhile, depending on the structure, a copolymer can exhibit a better property, such as a higher rate of decrease in thickness, than a homopolymer. The polyglycolic acid-based resin contained in the polyglycolic acid-based resin composition can be appropriately determined depending on the use environment and required properties of the downhole plug device. One type of the polyglycolic acid-based resin may be selected, or two or more types thereof may be combined.

The content of the polyglycolic acid-based resin in the polyglycolic acid-based resin composition may be 50 mass % or greater, preferably 60 mass % or greater, more preferably 70 mass % or greater, further preferably 80 mass % or greater, and still further preferably 90 mass % or greater, from the viewpoint of degradability. The content of the polyglycolic acid-based resin in the polyglycolic acid-based resin composition may be 99 mass % or less or 95 mass % or less from the viewpoint of degradability.

The weight average molecular weight of the polyglycolic acid-based resin composition is preferably 100000 or greater from the viewpoint of achieving the material properties required for an application in the present embodiment. Note that, in the present embodiment, the weight average molecular weight of a polymer compound such as the polyglycolic acid-based resin composition and polyglycolic acid can be measured by gel permeation chromatography (GPC).

In an embodiment of the present invention, the copolymer of glycolic acid is a random copolymer, a block copolymer, or a graft copolymer containing a repeating unit derived from glycolic acid (—(—O—$CH_2$—CO—)—) (hereinafter also referred to as a "glycolic acid unit") and another repeating unit. In particular, the copolymer of glycolic acid may be an ABA-type block copolymer in which a polymer chain composed of glycolic acid units is bonded to each end of a polymer chain containing another repeating unit, or a graft copolymer in which a polymer chain composed of glycolic acid units is graft-bonded to a polymer chain containing another repeating unit. Among them, the ABA-type block copolymer is preferably used from the viewpoint of improving the rate of decrease in thickness in degradation of a molded article of the polyglycolic acid-based resin composition.

Examples of a polymer compound providing a polymer chain containing another repeating unit include a polyol or a hydrophilic polyhydric alcohol-based polymer having a terminal hydroxy group. These polymer compounds are preferable because they form an ester bond with a polymer composed of glycolic acid units and easily improve the rate of decrease in thickness in degradation of a molded article of the resulting polyglycolic acid-based resin composition. Examples of the polyol include polyethylene glycol, polypropylene glycol, polytetramethylene ether glycol, polycaprolactone, polydioxanone, polydimethylsiloxane, and polyethylene oxalate. The term "polyol" may refer to a homopolymer or a copolymer.

Examples of the hydrophilic polyhydric alcohol-based polymer having a terminal hydroxy group include polyethylene glycol, polypropylene glycol, polyglycerin, and polyvinyl alcohol. The inclusion of a structural unit derived from the hydrophilic polyhydric alcohol-based polymer having a terminal hydroxy group improves the affinity of the polyglycolic acid-based resin with water during degradation, resulting in an effect of further improving the rate of decrease in thickness in degradation of a molded article of the polyglycolic acid-based resin composition.

The polyglycolic acid-based resin composition according to an embodiment of the present invention may contain a degradation accelerator that accelerates the degradation of the polyglycolic acid-based resin. Examples of the degradation accelerator include a carboxylic acid anhydride. The carboxylic acid anhydride can be appropriately selected within a range in which degradation of the polyglycolic acid-based resin composition can be promoted. The inclusion of the degradation accelerator can further increase the rate of decrease in thickness in degradation of a molded article of the polyglycolic acid-based resin composition.

The content of the carboxylic acid anhydride in the polyglycolic acid-based resin composition is preferably 1 mass % or greater, and more preferably 3 mass % or greater, from the viewpoint of improving degradability. The content of the carboxylic acid anhydride in the polyglycolic acid-based resin composition is preferably 50 mass % or less, more preferably 40 mass % or less, from the viewpoint of suppressing a decrease in the strength of a molded article of the polyglycolic acid-based resin composition due to bleed-out of the carboxylic acid anhydride. cl Other Components In the present embodiment, in addition to the above-described polyglycolic acid-based resin and degradation accelerator, the polyglycolic acid-based resin composition may further contain an additional component within a range in which the effects of the present embodiment can be achieved. The additional component may be of one type or a plurality of types and is used in an amount that allows the effects of the additional component to be exhibited.

Examples of the additional component include various additives such as a heat stabilizer, an antioxidant, a reinforcing material, a light stabilizer, a moisture-proof agent, a waterproof agent, a water-repellent agent, a lubricant, a hydrophilic agent, a water-absorbing agent, a nucleating agent, and a pore-forming agent. In addition, the composition may contain a polymerization initiator, a catalyst, or the like used in the preparation of the polyglycolic acid-based resin.

For example, the heat stabilizer is added during molding to impart thermal stability to the polyglycolic acid-based resin composition. A known heat stabilizer can be suitably used as the heat stabilizer. For example, a phosphorus compound can be used. Examples of the phosphorus compound include a mixture of distearyl acid phosphate and monostearyl acid phosphate ("ADK STAB AX-71" available from Adeka Corporation; "ADK STAB" is a registered trade mark of the company).

A known antioxidant can be suitably used as the antioxidant. Examples of the antioxidant include a hindered phenol compound, a sulfur compound, and a phosphorus compound. Examples of the hindered phenol compound include pentaerythritol tetrakis[3-(3,5-di-tert-butyl-4-hydroxyphenyl)propionate].

As reinforcing material, materials conventionally used as reinforcing materials for resin materials for the purpose of improving mechanical strength or heat resistance can be used, and a fibrous reinforcing material or a granular or powdered reinforcing material can be used. The reinforcing material may be contained typically in the amount of 150 parts by mass or less, and preferably in a range of from 10 to 100 parts by mass, per 100 parts by mass of the degradable material such as degradable resin.

Examples of the fibrous reinforcing material include glass fiber, carbon fiber, and cellulose fiber. The fibrous reinforcing material is preferably short fibers having a length of 10 mm or less, more preferably from 1 to 6 mm, still more preferably from 1.5 to 4 mm, and particularly preferably carbon fibers and glass fibers.

The granular or powdered reinforcing material that can be used include mica, silica, talc, alumina, calcium carbonate, ferrite, clay, glass powder, zinc oxide, quartz powder, and magnesium carbonate. The reinforcing material may be used alone or in combination of two or more. The reinforcing material may be treated with a sizing agent or surface treatment agent as necessary.

The polyglycolic acid-based resin composition can be molded by a known method. Examples of the molding method include injection molding, melt extrusion molding, compression molding (press molding), and centrifugal molding in addition to solidification extrusion molding. The plug in an embodiment of the present invention can be prepared as a molded product of the polyglycolic acid-based resin composition or a processed product of the molded product of the polyglycolic acid-based resin composition.

Method 1 of Using Downhole Plug Device

Next, a fixing method of a tubular body using a packer will be described as a method of using the downhole plug device of the present embodiment. FIG. 14 is a diagram schematically illustrating an example of an installation state of a downhole plug device according to an embodiment of the present invention. FIG. 15 is a diagram schematically illustrating another example of an installation state of a downhole plug device according to an embodiment of the present invention. FIG. 16 is a diagram schematically illustrating a state in which a downhole plug device according to an embodiment of the present invention is connected to the tip of a tubular body.

Usually, a casing 900 is inserted into a well, and a tubular body is inserted into the casing 900. The downhole plug device 1 is connected to the tip of the tubular body. The tubular body may be a tubing 910 which is a flow path connecting the ground and the underground, or may be a liner 930 installed in the casing 900.

The tubular body is provided with a packer 920. After being inserted into the casing 900, the packer 920 is actuated to engage with an inner wall of the casing 900, thereby fixing the tubular body to the casing 900. A known mechanism can be used as the actuation mechanism of the packer 920. In an embodiment of the actuation mechanism, after the tubular body is inserted into the casing 900, the movement of the tubular body on the ground side is suppressed while the internal pressure is increased to push the downhole plug device 1 toward the bottom of the well, actuating the packer 920 and fixing the tubular body to a desired position inside the casing 900. Thereafter, any well treatment, including the pressure test described below, can be performed. When the downhole plug device 1 is no longer needed, the plug 12 is removed from the housing 11 by increasing the internal pressure of the tubular body in the same manner as in a method to be described later of inspecting the connection state of a tubular body, or by the plug 12 degrading. In this way, the housing 11 can serve as a flow path for fluid at the tip part of the tubular body.

The downhole plug device 1 is directly or indirectly connected to the tip of the tubular body on the well bottom side. The housing 11 generally has an outer diameter greater than the outer diameter of the tubular body. For example, the housing 11 is directly connected to the tubular body by screwing a first threaded part formed on an inner circumferential wall on a second end side of the housing 11 onto a second threaded part formed on an outer circumferential wall on the tip side of the tubing 910 or the liner 930. Alternatively, the housing 11 is connected to the tip of the tubular body via a packer that is fitted to the tip of the tubular body.

Method 2 of Using Tubular Body

Next, a method of inspecting the connection state of a tubular body in a well will be described as another method of using the downhole plug device according to an embodiment of the present invention. As illustrated in FIG. 14 or FIG. 15, the downhole plug device 1 connected to the tip of the tubular body is inserted into the casing 900, and the packer 920 is actuated to fix the tubular body. The downhole plug device 1 may be used as described above to serve as an actuation mechanism of the packer 920. Next, the internal pressure of the tubular body (tubing 910 or liner 930) is increased to and maintained at the pressure test pressure, such as 3000 psi (20.7 MPa). A pressure test is then carried out. The presence of leakage of fluid in the tubular body is confirmed by measuring the fluctuation of the internal pressure during the pressure test.

The internal pressure of the tubular body is then increased to a pressure even higher than the pressure test pressure, for example, increased to 3500 psi (24.1 MPa). As such, as illustrated in FIG. 17, the force pushing the plug 12 due to the internal pressure of the tubular body exceeds the strength of the bolt 13. As a result, the bolt 13 breaks at any one or more locations on the X1 direction side from the first end of the housing 11, preferably at the first end of the housing 11, and the plug 12 detaches from the housing 11. With the detachment of the plug 12, the housing 11 causes the inside of the tubular body to communicate with the inside of the well and becomes a flow path of fluid at the tip of the tubular body.

Effect

The downhole plug device 1 includes the bolt 13 for fixing the plug 12 to the first end surface of the housing 11 in a direction along the axial direction of the housing 11. After the plug 12 is ejected from the first end of the housing 11 by increasing the internal pressure of the tubular body as described above, surface irregularities in a radial direction of the housing 11 due to the bolt 13 is not formed. As such, after the pressure test of a tubular body 1000, the housing 11 forms a flow path having a consistent diameter as a part (tip part) of the flow path of fluid in the tubular body.

When the internal pressure of the tubular body is increased and a force exceeding the strength of the bolt 13 is exerted on the bolt 13, the bolt 13 breaks. As such, the removal of the plug 12 from the housing 11 is easily carried out, and a flow path having a consistent diameter is reliably formed in the tubular body by the housing 11.

The downhole plug device including the plug 22 can be used in a method similar to that in the first embodiment described above, except that the method includes a step of sealing the through hole 224 with the ball 220 prior to the use of the downhole plug device including the plug 22. The ball 220 may be held within the tubular body in inserting the tubular body into the casing 900 and seated on the valve seat 225 when desired. Alternatively, the ball 220 may be thrown into the tubular body from the ground after the tubular body is inserted into the casing 900, conveyed to the valve seat 225, and seated on the valve seat 225.

The plug 22 includes the through hole 224. Therefore, before the through hole 224 is sealed by the ball 220, fluid can flow between the inside and the outside of the tubular body. This is advantageous from the viewpoint of smoothly inserting the tubular body into the casing 900.

In the present embodiment, the valve body is the ball 220. As such, even when the ball 220 is thrown into the tubular body that is inserted into the casing 900, the ball 220 does not break easily and reaches the valve seat 225 without difficulty. Further, the ball 220 can be closely attached to the valve seat 225 regardless of the orientation of the ball 220. This is advantageous from the viewpoint of reliably achieving the sealing of the tubular body using the valve body.

When the plug is made of a degradable material, the material constituting the plug degrades when the plug is kept inside the casing 900 for a specified period of time or longer for the plug to degrade in an environment in a well. In this way, the plug can also be removed from the housing 11 by degradation of material instead of by the bolt 13 breaking due to an increase in internal pressure as described above. Note that, the environment in the well varies; the temperature is approximately from 30 to 130° C., and a well is filled with steam or muddy water.

When the plug 82 is made of a degradable material, the peripheral ring member 822 and the core member 821 can use degradable materials having different degradation rates. For example, a degradable resin and a degradable metal may be used in combination. In particular, by using a material having a high degradation rate as the material constituting the peripheral ring member 822, the entire plug 82 can be quickly removed from the housing 11 due to the degradation of the peripheral ring member 822. The use of a material having a high degradation rate is particularly advantageous in view of the above when the pressure inside the tubular body is higher than the pressure outside the tubular body or when the downhole plug device is applied to a well that is a vertical well or an inclined well with a large inclination.

Since the plug 32 includes the recess 326, the minimum distance between surfaces of the head part 322 in a radial direction (referred to as an inter-surface distance) is from the circumferential surface of the recess 326 to the outer circumferential surface of the head part 322. The inter-surface distance of the plug 32 in a radial direction of the head part is shorter than the inter-surface distance of the plug 12, which is the outer diameter of the head part 122. As such, when the plug 32 is formed of a degradable material, it is expected that the degradation time of the head part 322 in a radial direction is shorter than that of the plug 12. Therefore, degradation of the plug in the well is further promoted, and the plug can be removed from the housing more quickly.

In addition, the plug 42 includes the groove 426, the plug 52 includes the groove 526, the plug 62 includes the groove 626, and thus a part having an inter-surface distance shorter than the plug 12 is formed in these plugs as with the case of the plug 32. Thus, constructing these plugs with a degradable material allows the plugs to be removed from the housing more quickly, as with the case of the plug 32.

The degradation time of the plug can be reduced by forming more parts with a short inter-surface distance of the plug. Furthermore, the degradation time of the plug can be reduced by reducing the inter-surface distance of a part of the plug.

The plug made of a degradable material is degraded in a well (underground) after use. As such, compared to a case of using a plug including a material that is not a degradable material, the plug including a degradable material is preferable from the viewpoint of reducing the risk that a separate downhole tool getting caught and hindering the entry or recovery of the separate downhole tool.

Other Embodiments

In an embodiment of the present invention, the number of the bolts, the bolt holes, and the bolt recesses may each be singular, but is preferably each plural from the viewpoint of reliably fixing the plug to the housing. When the plug is removed from the housing by the bolt breaking due to an increase in internal pressure, it is preferable that the plug is fixed by bolts at a number based on the intended use of the downhole plug device. A large number of bolts is preferred when the downhole plug device is used for a well treatment under high pressure. Meanwhile, a small number of bolts is preferred when the downhole plug device is used for a well treatment under low pressure. When there is a plurality of bolts, bolt holes, and bolt recesses, the intervals between the bolt holes are preferably equal from the above-described viewpoint, but the intervals between the bolt holes may also be irregular.

Also, in an embodiment of the present invention, the removal of the plug from the housing by the further application of pressure after use may be a result of the bolt falling out of the bolt recess instead of a result of the bolt breaking. Such removal of the plug can be achieved by appropriately adjusting the fastening force of the bolt in the bolt recess. The fastening force of the bolt in the bolt recess can be adjusted according to the length of the screw-thread part of the bolt in the bolt recess or the shape of the screw thread.

In an embodiment of the present invention, at least a portion of the plug may be made of a degradable material. For example, only the periphery of the bolt hole in the plug may be made of a degradable material. With such a configuration, the plug can detach from the housing due to degradation of the degradable material.

In addition, in the second embodiment, the valve body may be a valve body having another shape (for example, a substantially conical body) instead of a ball, and the ball seat may be something other than a funnel-shaped inclined surface.

In addition, in an embodiment of the present invention, both the step of leaving the plug made of a degradable resin for the degradation time or longer and the step of increasing the pressure to release the fixation of the plug to the housing via the fixing part may be performed.

The present invention is not limited to the embodiments described above, and various modifications are possible within the scope indicated in the claims. Embodiments obtained by appropriately combining the technical means disclosed by the various embodiments are also included in the technical scope of the present invention.

Summary

As is clear from the description above, the downhole plug device (1) in an embodiment of the present invention is fitted to the tip of a tubular body inserted into a well to temporarily seal the tubular body. The downhole plug device includes: a housing (11) having a cylindrical shape; a plug (12) that is inserted into the housing from one end of the housing and abuts one end surface of the housing to seal the housing; and a fixing part (bolt 13) that is inserted through the plug along an axial direction of the housing and fixes the plug to the one end surface of the housing.

In addition, a fixing method of a tubular body in an embodiment of the present invention includes fixing a tubular body inserted into a well including a casing to the casing by increasing an internal pressure of the tubular body with a tip of the tubular body sealed by a downhole plug device disposed at the tip of the tubular body to push the downhole plug device and moving the downhole plug device toward a well bottom side with respect to a packer provided in the tubular body. The downhole plug device is the above-described downhole plug device.

Furthermore, an inspection method of a tubular body according to an embodiment of the present invention is a method of inspecting presence or absence of leakage of fluid from a tubular body in a well. The method includes measuring an internal pressure of a tubular body inserted into a casing in a well by increasing the internal pressure with a tip of the tubular body sealed by a downhole plug device disposed at the tip of the tubular body. The downhole plug device to be used is the above-described downhole plug device.

As such, an embodiment of the present invention provides a downhole plug device that is less likely to hinder other operations after being removed, a fixing method of a tubular body, and an inspection method of a tubular body.

In an embodiment of the present invention, the plug may include a main body part (121) to be inserted into the housing from the one end of the housing and a head part (122) that abuts the one end surface of the housing with the main body part inserted into the housing. The head part may include a plurality of bolt holes (123) extending along the axial direction of the housing and opening to the one end surface of the housing, the housing may include a plurality of bolt recesses (113) opening at the one end surface of the housing, and the fixing part may correspond to a plurality of bolts (13) inserted through the bolt holes and screwed into the bolt recesses.

In an embodiment of the present invention, the plug may include a through hole (224) penetrating through the plug along an axial direction of the plug, a valve seat (225) formed around an opening of the through hole at an end surface of the plug located inside the housing, and a valve body (ball 220) closely attachable to the valve seat. This configuration is even more effective from the viewpoint of enabling smooth insertion of a tubular body into a well.

In an embodiment of the present invention, at least a portion of the plug may be made of a degradable material that degrades in the environment in the well. This configuration is preferable from the viewpoint of reducing the risk of a separate downhole tool getting caught and hindering the entry or recovery of the separate downhole tool.

In an embodiment of the present invention, the plug may include either or both of a groove (426) and a recess (326)

on its surface. This configuration is even more effective from the viewpoint of facilitating removal of the plug by the plug degrading.

The inspection method of a tubular body according to an embodiment of the present invention may further include removing the plug from the housing by increasing the internal pressure of the tubular body to push the plug and breaking the fixing part. This configuration is even more effective from the viewpoint of quickly forming a flow path of the tubular body formed by the housing.

In the inspection method of a tubular body according to an embodiment of the present invention, at least a portion of the plug may be made of a degradable material that degrades in the environment in a well, and the inspection method may further include removing the plug from the housing by keeping the plug in the well for a specified period of time or longer for the plug to degrade in the environment in the well. This configuration is more effective from the viewpoint of easily forming a flow path of the tubular body formed by the housing.

INDUSTRIAL APPLICABILITY

The present invention can be used to extract underground resources from wells, and can be expected to reduce the burden on the environment in extracting underground resources.

REFERENCE SIGNS LIST

1, 7 Downhole plug device
11 Housing
12, 22, 32, 42, 52, 62, 72, 82 Plug
13 Bolt (fixing part)
113 Bolt recess
121, 221, 621 Main body part
122, 222, 322, 422, 522, 622, 722 Head part
123 Bolt hole
127, 426, 526, 626 Groove
128 O-ring
129, 741 Recessed part
220 Ball (valve body)
224 Through hole
225 Valve seat
326 Recess
729 Notch part
740 Fixture
742 Hole
821 Core member
822 Peripheral ring member
900 Casing
910 Tubing
920 Packer
930 Liner

The invention claimed is:

1. A downhole plug device to be used for temporarily sealing a tubular body to be inserted into a well by fitting into the tubular body at a tip of the tubular body, the downhole plug device comprising:

a housing having a cylindrical shape;

a plug that is inserted into the housing from one end of the housing and abuts one end surface of the housing to seal the housing; and a fixing part that is inserted through the plug along an axial direction of the housing and fixes the plug to the one end surface of the housing.

2. The downhole plug device according to claim 1, wherein the plug comprises a main body part to be inserted into the housing from the one end of the housing and a head part that abuts the one end surface of the housing with the main body part inserted into the housing, the head part comprises a plurality of bolt holes extending along the axial direction of the housing and opening to the one end surface of the housing, the housing comprises a plurality of bolt recesses opening at the one end surface of the housing, and the fixing part corresponds to a plurality of bolts inserted through the bolt holes and screwed into the bolt recesses.

3. The downhole plug device according to claim 1, wherein the plug comprises a through hole penetrating through the plug along an axial direction of the plug, a valve seat formed around an opening of the through hole at an end surface of the plug located inside the housing, and a valve body closely attachable to the valve seat.

4. The downhole plug device according to claim 1, wherein at least a portion of the plug is made of a degradable material that degrades in an environment in the well.

5. The downhole plug device according to claim 4, wherein the plug comprises either or both of a groove and a recess on a surface of the plug.

6. A fixing method of a tubular body, comprising inserting a tubular body with a downhole plug device and a packer into a well including a casing;

fixing the tubular body to the casing by increasing an internal pressure of the tubular body with a tip of the tubular body sealed by the downhole plug device disposed at the tip of the tubular body, wherein the downhole plug device comprises a housing having a cylindrical shape, a plug that is inserted into the housing from one end of the housing and abuts one end surface of the housing to seal the housing, and a fixing part that is inserted through the plug along an axial direction of the housing and fixes the plug to the one end surface of the housing.

7. An inspection method of a tubular body in a well for inspecting presence or absence of leakage of fluid from the tubular body, the inspection method comprising measuring an internal pressure of the tubular body inserted into a casing in the well by increasing the internal pressure with a tip of the tubular body sealed by a downhole plug device disposed at the tip of the tubular body, wherein the downhole plug device comprises a housing having a cylindrical shape, a plug that is inserted into the housing from one end of the housing and abuts one end surface of the housing to seal the housing, and a fixing part that is inserted through the plug along an axial direction of the housing and fixes the plug to the one end surface of the housing.

8. The inspection method according to claim 7, further comprising removing the plug from the housing by increasing the internal pressure of the tubular body to push the plug and break the fixing part.

9. The inspection method according to claim 7, wherein at least a portion of the plug is made of a degradable material that degrades in an environment in the well, the method further comprising removing the plug from the housing by keeping the plug in the well for a specified period of time for the plug to degrade in the environment in the well.

* * * * *